United States Patent [19]

DeRosa et al.

[11] Patent Number: 5,035,819

[45] Date of Patent: Jul. 30, 1991

[54] DISPERSANT, VI IMPROVER, ADDITIVE AND LUBRICATING OIL COMPOSITION CONTAINING SAME

[75] Inventors: Thomas F. DeRosa, Passaic, N.J.; Benjamin J. Kaufman, Hopewell Junction; Rosemary J. Jennejahn, Nelsonville, both of N.Y.

[73] Assignee: Texaco, Inc., White Plains, N.Y.

[21] Appl. No.: 479,008

[22] Filed: Feb. 9, 1990

[51] Int. Cl.[5] ..... C10M 107/48; C10M 153/02

[52] U.S. Cl. ..... 252/49.9; 525/329.1; 525/329.2; 525/329.3

[58] Field of Search ..... 525/329.1, 329.2, 329.3; 252/49.9

[56] References Cited

U.S. PATENT DOCUMENTS

| | | | |
|---|---|---|---|
| 3,522,180 | 7/1970 | Sweeney | 526/348 |
| 4,026,809 | 5/1977 | Lachowicz | 252/51.5 R |
| 4,146,489 | 11/1983 | Stambaugh | 252/50 |
| 4,239,860 | 12/1980 | Hergenrother et al. | 525/329.2 |
| 4,299,932 | 11/1981 | Hergenrother et al. | 525/329.1 |
| 4,340,689 | 7/1982 | Joffrion | 252/50 |
| 4,459,386 | 7/1984 | Grundmann | 525/329.2 |
| 4,780,228 | 10/1988 | Gardiner | 252/56 D |

*Primary Examiner*—Prince E. Willis
*Assistant Examiner*—Ellen McAvoy
*Attorney, Agent, or Firm*—Robert A. Kulason; James J. O'Loughlin; Vincent A. Mallare

[57] ABSTRACT

A lubricant additive that imparts enhanced dispersancy and antioxidancy has been prepared by reacting a copolymer or terpolymer with an acrylating agent followed by treatment with a dialiphatic or aromatic phosphate. The copolymer is prepared from ethylene and at least one ($C_3$–$C_{10}$) alpha-monoolefin and, optionally, a polyene selected from non-conjugated dienes and trienes comprising from about 15 to 80 mole percent of ethylene, from about 20 to 85 mole percent of said ($C_3$–$C_{10}$) alpha-monoolefin and from about 0 to 15 mole percent of said polyene having a number average molecular weight ranging from about 5,000 to about 500,000.

13 Claims, No Drawings

DISPERSANT, VI IMPROVER, ADDITIVE AND LUBRICATING OIL COMPOSITION CONTAINING SAME

BACKGROUND OF THE INVENTION

This invention relates to a novel multi-functional lubricant additive which is a Viscosity Index Improver (VII), and a dispersant and anti-oxidant additive when employed in a lubricating oil composition.

The use of polymer additives in lubricating oil compositions is well known in the art. For example, ethylene-propylene copolymers and ethylene-alpha olefin non-conjugated diene terpolymers which have been further derivatized to provide bifunctional properties in lubricating oil compositions illustrate this type of oil additive.

Thus, an objective of this invention is to provide a novel derivatized graft copolymer composition.

Another object of the invention is to provide a multi-functional lubricant additive effective as a (VII) that imparts dispersant and antioxidant properties to the lubricating oil composition.

A further object is to provide a novel lubricating oil composition containing the graft copolymer additive of the invention as well as to provide concentrates of the novel additive of invention.

DISCLOSURE STATEMENT

The art is replete with disclosures on the use of polymer additives in lubricating oil compositions. Ethylene-propylene copolymers and ethylene-alpha olefin non-conjugated diene terpolymers which have been further derivatized to provide bifunctional propertities in lubricating oil compositions illustrate this type of oil additive.

U.S. Pat. No. 3,522,180 discloses a method for the preparation of an ethylene-propylene copolymer substrate effective as a viscosity index improver (VII) for lubricating oils.

U.S. Pat. No. 4,026,809 discloses graft copolymers of a methacrylate ester and an ethylene-propylene-alkylidene norbornene terpolymer as a viscosity index improver for lubricating oils.

U.S. Pat. No. 4,146,489 discloses a graft copolymer where the polymer backbone is an oil-soluble ethylene-propylene copolymer or an ethylene-propylenediene modified terpolymer with a graft monomer of 2- or 4-vinylpyridine or N-vinylpyrrolidone to provide a dispersant VI improver for lubricating oils.

U.S. 4,340,689 discloses a process for grafting a functional organic group onto an ethylene-propylene copolymer or an ethylene-propylene-diene terpolymer.

U.S. 4,780,228 discloses the grafting of a hydrocarbon polymer in the absence of a solvent in the presence of a free radical initiator and a claim-stopped agent followed by a reaction with an amine, polymers an aminoalcohol.

The disclosures in the foregoing patents which relate to VI improvers and dispersants for lubricating oils, namely U.S. Pat. No. 3,522,180; 4,026,809; 4,146,489; 4,340,689; and 4,780,689 are incorporated herein by reference.

SUMMARY OF THE INVENTION

The novel reaction product of the invention comprises a chemical modification of an ethylene copolymer or terpolymer. Terpolymers are typically ($C_3$ to $C_{10}$) alpha-monoolefin as well as a non-conjugated diene or triene. The lubricating oil is characterized as a viscosity index improver (VII) with enhanced dispersant and antioxidant propertities.

The invention comprises a chemical modification of an ethylene propylene copolymer or terpolymer by chemically incorporating 2-isocyanoethylacrylate (I)

$$CH_2{=}CH{-}COO{-}CH_2CH_2{-}NCO \qquad (I)$$

and then derivatizing with aliphatic or aromatic phosphites, (RO)2P(O)H. In this manner, pendant phosphourethanes are randomly incorporated onto the polymeric substrate.

Dialiphatic phosphites that may be used to generate phosphourethanes are represented by the following formula:

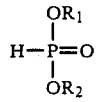

(Dialiphatic Phosphite)

where $R_1$ and $R_2$ are ($C_1$–$C_{15}$) acyclic alkyl groups or ($C_5$–$C_{10}$) cyclic groups.

Diaromatic phosphites that may be used to generate phospho-urethanes are represented by the following formula:

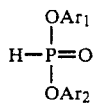

(Diaromatic Phosphite)

where $Ar_1$ and $Ar_2$ are aromatic rings containing at least two ring substituents per aromatic ring. These ring substituents may consist of ($C_1$–$C_{10}$) acyclic aliphatic substituents; ($C_4$–$C_{10}$) cyclic aliphatic substituents; halides, for instance fluorine chlorine, bromine, or iodine, chlorine being the preferred atom; primary, secondary, or tertiary amines, tertiary atoms being the preferred amines; or mixtures of the aforementioned, especially those containing chlorine and tertiary amines.

DETAILED DESCRIPTION OF THE INVENTION

The polymer or copolymer substrate employed in the novel additive of the invention may be prepared from ethylene or propylene or it may be prepared from ethylene and a higher olefin with the range of $C_3$ to $C_{10}$ alpha-olefins.

More complex polymer substrates, often designated as interpolymers, may be prepared using a third component. The third component generally used to prepare an interpolymer substrate is a polyene monomer selected from non-conjugated dienes and trienes. The non-conjugated diene component is one having from 5 to 14 carbon atoms in the chain. Preferably, the diene monomer is characterized by the presence of a vinyl group in its structure and can include cyclic and bi-cyclo compounds. Representative dienes include 1,4-hexadiene, 1,4-cyclohexadiene, dicyclopentadiene, 5-ethylidene-2-norbornene, 5-methylene-2-norborene, 1,5-heptadiene, and 1,6 octadiene. A mixture of more than one diene can be used in the preparation of the interpolymer. A preferred non-conjugated diene for preparing a terpolymer or interpolymer substrate is 1,4-hexadiene.

The triene component will have at least two nonconjugated double bonds, and up to about 30 carbon atoms in the chain. Typical trienes useful in preparing the interpolymer of the invention are 1-isopropylidene-3,4,7,7-tetrahy-droindene, 1-isopropylidenedicyclopentadiene, dehydroisodicyclopentadiene, and 2-(2-methylene-4-methyl-3-pentenyl)-[2,2,1] bicyclo-5-heptene.

The polymerization reaction to form the polymer substrate is generally carried out in the presence of a catalyst in a solvent medium. The polymerization solvent may be any suitable inert organic solvent that is liquid under reactions conditions for solution polymerization of monoolefins which is generally conducted in the presence of a Ziegler-Natta type catalyst. Examples of satisfactory hydrocarbon solvents include straight chain paraffins having from 5–8 carbon atoms, with hexane being preferred. Aromatic hydrocarbon, preferably aromatic hydrocarbon having a single benzene nucleus, such as benzene, toluene and the like; and saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. It is desirable that the solvent be free of substances that will interfere with the Ziegler-Natta polymerization process.

In a typical preparation of the polymer substrate, hexane is first introduced into a reactor and the temperature in the reactor is raised moderately to about 30° C. Dry propylene is fed to the reactor until the pressure reaches about 40–45 inches of mercury. The pressure is then increased to about 60 inches of mercury and dry ethylene and 5-ethylidene-2-norbornene are fed to the reactor. The monomer feeds are stopped and a mixture of aluminum sesquichloride and vanadium oxytrichloride are added to initiate the polymerization reaction. Completion of the polymerization reaction is evidenced by a drop in the pressure in the reactor.

Ethylene-propylene or higher alpha monoolefin copolymers may consist of from about 15 to 80 mole percent ethylene and from about 20 to 85 mole percent propylene or higher monoolefin with the preferred mole ratios being from about 25 to 75 mole percent ethylene and from about 25 to 75 . mole percent of a $C_3$ to $C_{10}$ alpha monoolefin with the most preferred proportions being from 25 to 55 mole percent ethylene and 45 to 75 mole percent propylene.

Terpolymer variations of the foregoing polymers may contain from about 0.1 to 10 mole percent of a non-conjugated diene or triene.

The polymer substrate, that is the ethylene copolymer or terpolymer is an oil-soluble, substantially linear, rubbery material having a number average molecular weight ranging from about 5,000 to about 500,000 with a preferred number average molecular weight ranging from about 25,000 to 250,000 and a most preferred range of from about 50,000 to 150,000.

The terms polymer and copolymer are used generically to encompass ethylene copolymers, terpolymers or interpolymers. These materials may contain minor amounts of other olefinic monomers so long as their basic characteristics are not materially changed.

The substituted acrylate may be grafted onto the polymer backbone in a number of ways. It may be grafted onto the backbone by a thermal process known as the "ene" process or by grafting in solution using a free radical initiator. The free-radical induced grafting of substituted acrylates in nonpolar solvents containing 5–9 carbon atoms or monoaromatic solvents, benzene being the preferred method. It is carried out at an elevated temperature in the range of about 100° C. to 250° C., preferably 120° C. to 190° C., and more preferably at 150° C. to 180° C., e.g. above 160° C., in a solvent, preferably a mineral lubricating oil solution, containing, e.g. 1 to 50, preferably 5 to 30 wt% bases on the initial total oil solution, of the ethylene polymer and preferably under an inert atmosphere.

The free radical initiators which may be used are peroxides, hydroperoxides, and azo compounds and preferably those which have a boiling point greater than 100° C. and decompose thermally within the grafting temperature range to provide free radicals. Representative of these free radical initiators are azobutronitrile and 2,5-dimethyl-hex-3-yne-2,5-bis tertiary-butyl peroxide. The initiator is used in an amount of between 0.005% and about 2% by weight based on the weight of the reaction mixture solution. The grafting is preferably carried out in an inert atmosphere, preferably nitrogen. The resulting polymer is characterized by having 2isocyanoethylacrylate functions within its structure.

Polymer substrates or interpolymers are available commerically. Particularly useful are those containing from about 40 to 60 mole percent ethylene units, about 60 to 40 mole percent propylene units. Examples are "Ortholeum 2052" and "PL-1256" available from E.I.-duPont deNemours and Co. The former is a terpolymer containing 48 mole percent ethylene units, 48 mole percent propylene, and 4 mole percent 1,4-hexadiene units, having an inherent viscosity of 1.35. The latter is a similar polymer with a inherent viscosity of 1.95. The viscosity average molecular weights of the two are on the order of 200,000 and 280,000, respectively.

The polymer intermediate possessing a 2-iso cyanoethyl-acrylate function is reacted with dialiphatic or diaromatic phosphites represented by the following formulas:

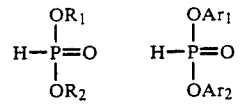

(Dialiphatic Phosphite) (Diaromatic Phosphite)

in which R represents hydrogen or an alkyl or alkoxy radical having from 1 to 15 carbons, while Ar represents an aromatic ring containing at least two substituents per aromatic ring.

The reaction between the polymer substrate intermediate having grafted thereon 2-isocyanoethylacrylate function and dialiphatic or diaromatic phosphite is conducted by heating a solution of the graft copolymer under inert conditions and then adding either phosphite to the heated solution with stirring to effect the reaction. It is convenient to employ an oil solution of the graft copolymer heated to 140° to 175° C. while maintaining the solution under a nitrogen blanket. The addition of either phosphite is added to this solution and the reaction effected under these conditions.

The following examples illustrate the preparation and advantages of the novel reaction product additive of this invention.

EXAMPLE 1

Preparation of OCP-g-2-isocyanoethylacrylate

Two hundred grams of polymeric substrate consisting of about 60 mole percent ethylene and 40 mole percent propylene and having a number average molecular weight of 80,000 was dissolved in 1440 grams of solvent neutral oil at 160° C. using a mechanical stirrer while the mixture was maintained under a blanket of nitrogen. After the rubber was dissolved, the mixture was heated an additional hour at 160° C. Ten grams of 2-isocyanoethylacrylate dissolved in 10 grams of solvent neutral oil was added to the above mixture along with 2.5 grams dicumyl-peroxide also dissolved in 10 grams of oil. The mixture reacted for 2.5 hours at 160° C. then filtered through a 200 mesh screen.

EXAMPLE 2

Reaction of OCP-g-2-isocyanoethylacrylate with dimethyl phosphite

Twenty six grams of the aforementioned graft copolymer of Example 1 was dissolved in 174 grams of solvent neutral oil at 160° C. using mechanical stirring under a nitrogen blanket. Dimethyl phosphite, 2.1 grams, is added next to the mixture and the reaction heated for an additional two hours under the aforementioned conditions. The mixture was then cooled to 120° C. and filtered through a 200 mesh filter.

EXAMPLE 3

Reaction of OCP-g-isocyanoethylacrylate with diethyl phosohite

Diethyl phosphite may be substituted in the aforementioned illustration of Example 2 using OCP-g-2-isocyanoethylacrylate.

EXAMPLE 4

Reaction of OCP-g-2-isocyanoethylacrylate with di(2,3-dimethyl-n-hexyl) phosphite Di(2,3-dimethyl-n-hexyl) phosphite may be substituted in the in the aforementioned illustration of Example 3 using OCP-g-isocyanoethylacrylate.

EXAMPLE 5

Reaction of OCP-g-2-isocyanoethylacrylate with di(2,5-di-chloro-phenyl) phosphite Di(2,5-di-chloro-phenyl) phosphite may be substituted in the aforementioned illustration of Example 4 using OCP-g-2-isocyanoethylacrylate.

EXAMPLE 6

Reaction of OCP-g-2-isocyanoethylacrylate with di(2-chloro-3-N,N-dimethyl-phenyl) phosphite Di(2-chloro-3-N,N-dimethyl-phenyl) phosphite may be substituted in the aforementioned illustration of Example 5 using OCP-g-2-isocyanoethylacrylate.

EXAMPLE 7

Reaction of OCP-g-2-isocyanoethyl acrylate with di(2,3-dichloro-5-N,N-dimethyl-phenyl) phosphite Di(2,3-dichloro-5-N,N-dimethyl-phenyl) phosphite may be substituted in the aforementioned illustration of Example 6 using OCP-g-2-isocyanoethylacrylate.

The novel graft and derivatized polymer of the present invention is useful as an additive for lubricating oils. In particular, these material are VI improver that impact enhanced dispersany and anti-oxidancy to lubricating oils. They can be employed in a variety of oils of lubricating viscosity including natural and synthetic lubricating oils and mixtures thereof. The novel additives can be employed in crankcase lubricating oils for spark-ignited and compression-ignited internal combustion engines. The compositions can also be used in gas engines, or turbines, automatic transmission fluids, gear lubricants, metal-working lubricants, hydraulic fluids, and other lubricating oil and grease compositions. Their use in motor fuel compositions is also contemplated.

The base oil may be a natural oil including liquid petroleum oils and solvent-treated or acid-treated mineral lubricating oils of the paraffinic, naphthenic and mixed paraffinic-naphthenic types.

In general, the lubricating oil composition of the invention will contain the novel reaction product in a concentration ranging from about 0.1 to 30 weight percent. A preferred concentration range for the additive is from about 1 to 15 weight percent based on the total weight of the oil composition.

Oil concentrates of the additive may contain from about 1 to 50 weight percent of the additive reaction product in a carrier or diluent oil of lubricating oil viscosity.

The novel reaction product of the reaction may be employed in lubricating oil compositions together with conventional lubricant additives. Such additives may include additional dispersants, detergents, anti-oxidants, pour point depressants, anti-wear agents and the like.

The dispersant propertities of the additive-containing oil are determined in the Bench VC Dispersancy Test (BVCT). Dispersancy of a lubricating oil is determined relative to three references which are the results from three standards blends tested with the unknown. The test additives were blended into a formulated oil containing no dispersant. The additive reaction product was employed in the oil at a concentration of 12.0 weight percent polymer solution.

The product prepared in examples 1 and 2 were blended into formulations not containing dispersant to form 1.20 weight percent polymer solutions. These blends were tested for dispersancy in the Bench VC Test (Table I). In this test dispersancy is compared to that of three reference oils which are tested along with the experimental samples. The numerical value of a test decreases with an increase of dispersant effectiveness.

TABLE I

| Bench V Dispersancy Testing | |
|---|---|
| VI Improver | Rating |
| Example 1 (underivatized OCP-g-2-isocyanoethylacrylate | 92 |
| Example 2 | 43 |
| Example 3 | 37 |
| Example 7 | 47 |
| OCP | 99 |

TABLE I-continued

| Bench V Dispersancy Testing | |
|---|---|
| VI Improver | Rating |
| Commercial NVP grafted DOCP | 68 |

The OCP base rubber and number average molecular weight are similar in all illustrations in Table I.

The results from the BVCT Test show that the dispersant VI improver prepared in Examples 2, 4, and 5 gave better dispersancy performance then the corresponding OCP and OCP-g-isocyanoethylacrylate and superior performance to a commercial NVP grafted DOCP VI Improver.

The anti-oxidant propertities of the novel reaction product in a lubricating oil were determined in the Bench Oxidation Test. In this test, 1.5 weight percent of the additive reaction product was blended into solvent neutral oil and the mixture heated to 100° F. while air is bubbled through the mixture. Samples are withdrawn periodically and analyzed by Differential Infrared Absorption (DIR) to observe changes in the intensity of the carbonyl vibrational band at 1710 cm−1. A lower carbonyl vibrational band intensity indicates higher thermal-oxidative stability of the sample. Results of Bench Oxidation Testing are summarized below in Table II.

TABLE II

| BENCH OXIDATION TEST | | |
|---|---|---|
| Example | Additive | Results |
| 1 | OCP-g-2-isocyanoethyl-acrylate | 96.0<br>18.0 |
| 3 | OCP-g-2-isocyanoethyl-acrylate and diethyl phosphite | 2.6 |
| 7 | OCP-g-2-isocyanoethyl-acrylate and di(2,3-dichlor-N,N-dimethyl-phenyl) phosphite | 4.8 |

The test results for Example I and VII demonstrate substantial improvement in anti-oxidant propertities due to the incorporation of the novel reaction product of the invention in an oil composition as compared to the results obtained using a known dispersant VI improver and the underivatized graft copolymer.

What is claimed is:

1. A method of preparing an additive composition for lubricating oils comprising:

(a) reacting (i) reacting a polymer prepared from ethylene and at least one ($C_3$–$C_{10}$) alpha-monoolefin comprising from about 15 to 80 mole percent of ethylene and from about 20 to 85 mole percent of said ($C_3$–$C_{10}$) alpha-monoolefin, and said polymer having a number average molecular weight ranging from about 5,000 to about 500,000; and (ii) 2-isocyanoethylacrylate which has a reactive pendant 2-isocyanoethylacrylate within its structure, to provide an intermediate; and (b) reacting said intermediate with a phosphite compound selected from the group consisting of dialkyl phosphite or diaromatic phosphite

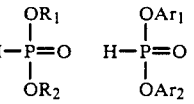

in which $R_1$ and $R_2$ is an alkyl group having from 1 to 15 carbon atoms, or a ($C_5$–$C_{10}$) cyclic group, and Ar is an aromatic ring containing at least two substituents per aromatic ring, to provide said additive composition; and (c) recovering said additive composition.

2. The method according to claim 1 in which said polymer has a number average molecular weight ranging from about 50,000 to about 500,000.

3. The method according to claim 1 in which said polymer has a number average molecular weight ranging from about 50,000 to about 150,000.

4. The method according to claim 1 in which said polymer comprises from about 25 to 80 mole percent ethylene and from about 20 to 75 mole percent of a ($C_3$–$C_8$) alpha-monoolefin.

5. The method according to claim 1 in which said polymer comprises from about 25 to 55 mole percent ethylene and from about 45 to 75 mole percent of propylene.

6. The method according to claim 1 in which said dialiphatic phosphite compound is diethyl phosphite.

7. The method according to claim 1 in which said diaromatic phosphite compound is di(2,3-dichloro-5-N,N-dimethyl-phenyl) phosphite.

8. A lubricating oil composition comprising a major amount of an oil of lubricating viscosity and a minor amount of the polymer of claim 1 to impart properties of viscosity index improvement and dispersancy to said lubricating oil composition.

9. A concentrate for a lubricating oil comprising a diluent oil of lubricant viscosity and from about 1 to 50 weight percent of the additive composition of claim 1 based on the total weight of the concentrate.

10. A method of preparing a lubricating oil composition comprising:

(a) reacting (1) reacting a polymer prepared from ethylene and at least one ($C_3$–$C_{10}$) alpha-monoolefin comprising from about 15 to 80 mole percent of ethylene and from about 20 to 85 mole percent of said ($C_3$–$C_{10}$) alpha-monoolefin, and said polymer having a number average molecular weight ranging from about 5,000 to about 500,000; and (ii) 2-isocyanoethylacrylate which has a reactive pendant 2-isocyanoethylacrylate within its structure, to provide an intermediate; and (b) reacting said intermediate with a phosphite compound selected from the group consisting of dialkyl phosphite or diaromatic phosphite

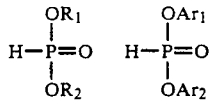

in which $R_1$ and $R_2$ is an alkyl group having from 1 to 15 carbon atoms, or a ($C_5$–$C_{10}$) cyclic group, and Ar is an aromatic ring containing at least two substituents per aromatic ring, to provide said additive composition; and (c) recovering said lubricating oil composition.

11. The method according to claim 10 in which said polymer comprises from about 25 to 75 mole percent ethylene and from about 25 to 75 mole percent of a ($C_3$ to $C_8$) alpha-monoolefin and has a number average molecular weight ranging from about 25,000 to about 250,000.

12. The method according to claim 10 in which said dialiphatic phosphite is diethyl phosphite.

13. The method according to claim 10 in which said diaromatic phosphite is di(2,3-dichloro-5-N,N-dimethyl-phenyl) phosphite.

* * * * *